United States Patent [19]

Chiu et al.

[11] Patent Number: 4,906,139

[45] Date of Patent: Mar. 6, 1990

[54] OFFSHORE WELL TEST PLATFORM SYSTEM

[75] Inventors: Hin Chiu, Sugar Land; Donald K. Nelsen, Houston, both of Tex.

[73] Assignee: Amoco Corporation, Chicago, Ill.

[21] Appl. No.: 263,150

[22] Filed: Oct. 27, 1988

[51] Int. Cl.[4] ..... B63B 35/44; E02B 17/00

[52] U.S. Cl. ..... 405/224; 405/195; 405/203; 114/205

[58] Field of Search ..... 405/195, 203, 204, 209, 405/224, 202; 114/264, 265, 266

[56] References Cited

U.S. PATENT DOCUMENTS

| | | | |
|---|---|---|---|
| 3,982,401 | 9/1976 | Loggins | 405/224 X |
| 3,982,492 | 9/1976 | Steddum | 405/205 X |
| 4,169,424 | 10/1979 | Newby et al. | 114/265 |
| 4,170,186 | 10/1979 | Shaw | 114/264 |
| 4,395,160 | 7/1983 | deJong | 405/195 |
| 4,455,108 | 6/1984 | Lausberg | 405/202 |
| 4,626,137 | 12/1986 | Willemsz | 405/224 |
| 4,674,918 | 6/1987 | Kalpins | 405/224 |

FOREIGN PATENT DOCUMENTS

| | | | |
|---|---|---|---|
| 606919 | 5/1978 | U.S.S.R. | 405/203 |

*Primary Examiner*—Randolph A. Reese
*Assistant Examiner*—John A. Ricci
*Attorney, Agent, or Firm*—Scott H. Brown; Fred E. Hook

[57] ABSTRACT

An offshore well test platform system is positionable above one or more underwater wells and comprises a submerged buoy restrained below the surface of the water by a plurality of laterally extending, tensioned cables, a platform structure removably connected to a submerged buoy with an upper portion that extends above the surface of the water, and a flexible riser that connects the well to a well test platform deck above the surface of the water.

6 Claims, 3 Drawing Sheets

OFFSHORE WELL TEST PLATFORM SYSTEM

BACKGROUND OF THE INVENTION

1. Field of the Invention

The present invention relates to an offshore well test platform and, more particularly, to a well test platform that is supported by a submerged buoy.

2. Description of the Prior Art

In the offshore exploration for hydrocarbons, after a discovery has been made, numerous well tests are conducted to evaluate the economic potential of the reservoir to produce hydrocarbons therefrom economically. To perform these well tests, a stable platform is needed to support equipment, storage tanks and personnel. A vessel can be preferably dynamically positioned above the wells and then interconnected via a riser to the well to conduct such well test or workover operations. Such vessels are expensive to use on long duration tests and are very difficult to work on due to wind and wave-induced heave, roll, and pitch motions. An alternative is to utilize simple well protector jacket structures; however, these structures are feasible only in shallow water. In deeper waters, a fixed well protector platform or structure may be constructed and installed above the well. While a fixed platform is not affected by wind and wave induced motion, a platform of this type is a very expensive investment. Because, if the platform is installed and from the well tests conducted the reservoir is economically unproductive, then the cost of such a platform has been wasted.

There is a need for an inexpensive, stable well test platform which, if desired, can be easily removed and placed in other locations in deep waters.

One type of well test platform, which is shown in FIG. 1, includes two buoys vertically aligned with one at the surface and one below the surface of the water, and which are anchored to the subsea floor by a single tensioned rigid riser in the same manner as a tension leg platform (TLP). One of the major concerns of the use of this type of well test platform is that while there is little or no heave motion, there can be unacceptable angular or pitching motion. Also, it is not capable of servicing multiple wells.

SUMMARY OF THE INVENTION

The present invention has been contemplated to overcome the foregoing deficiencies and meet the above-described needs. The present invention is a stable, inexpensive offshore well test and workover platform system that is positionable above one or more underwater wells in deep water and that is easily removed and placed in other locations. The well test platform system generally includes a submerged buoy restrained below the surface of the water in a quiescent zone below the action of wind and waves by a plurality of anchoring devices, such as equally spaced, laterally extending tensioned mooring lines or cables connected to bottom anchors. A jacket platform structure is connected to the submerged buoy with an upper portion extending above the surface of the water for support of winches and other well test equipment on top of a deck attached thereto. One or more flexible risers connect the subsea wells through submerged buoy to the surface of the platform deck so that well tests or wireline workover operations can be conducted.

DETAILED DESCRIPTION OF THE PREFERRED EMBODIMENTS

As described above, the present invention is an offshore well test platform system that is positionable above one or more underwater wells, and generally comprises a submerged buoy, a platform structure which is either fixed or removably attached thereto, and one or more flexible risers that connect the subsea well to the platform structure.

Figure 1:
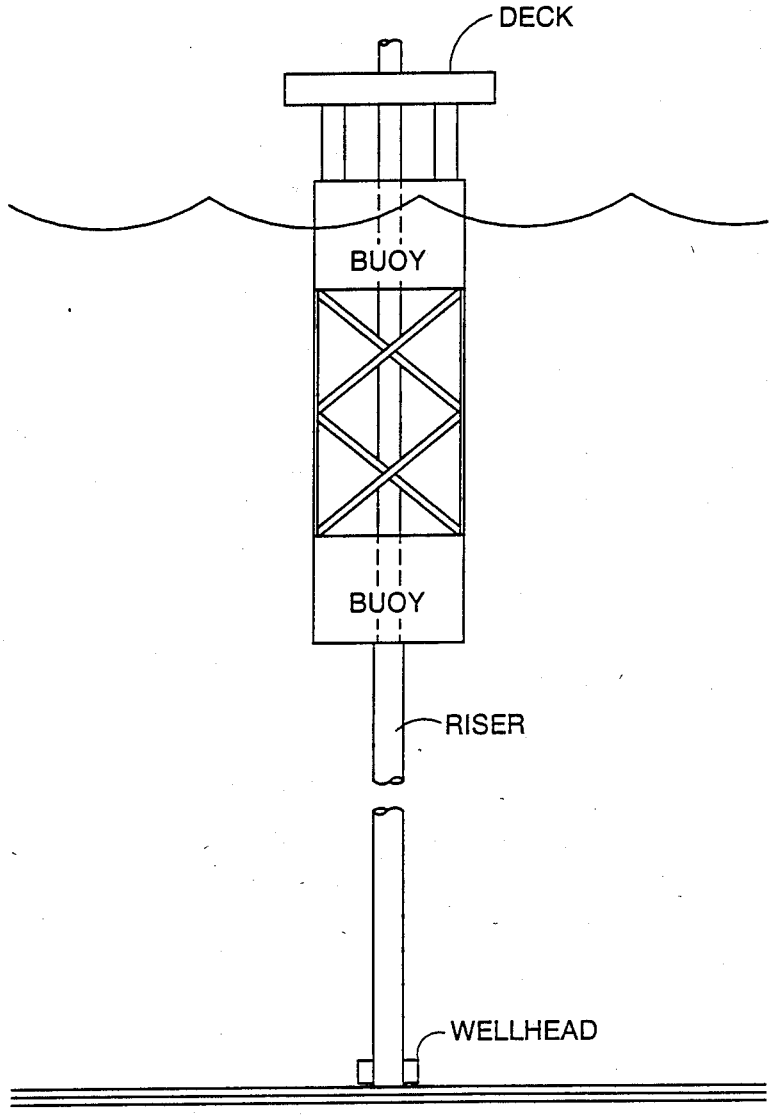
PRIOR ART FIG. 1
FIG. 1 is an elevational view of an offshore well test platform of the Prior Art.
Figure 2:
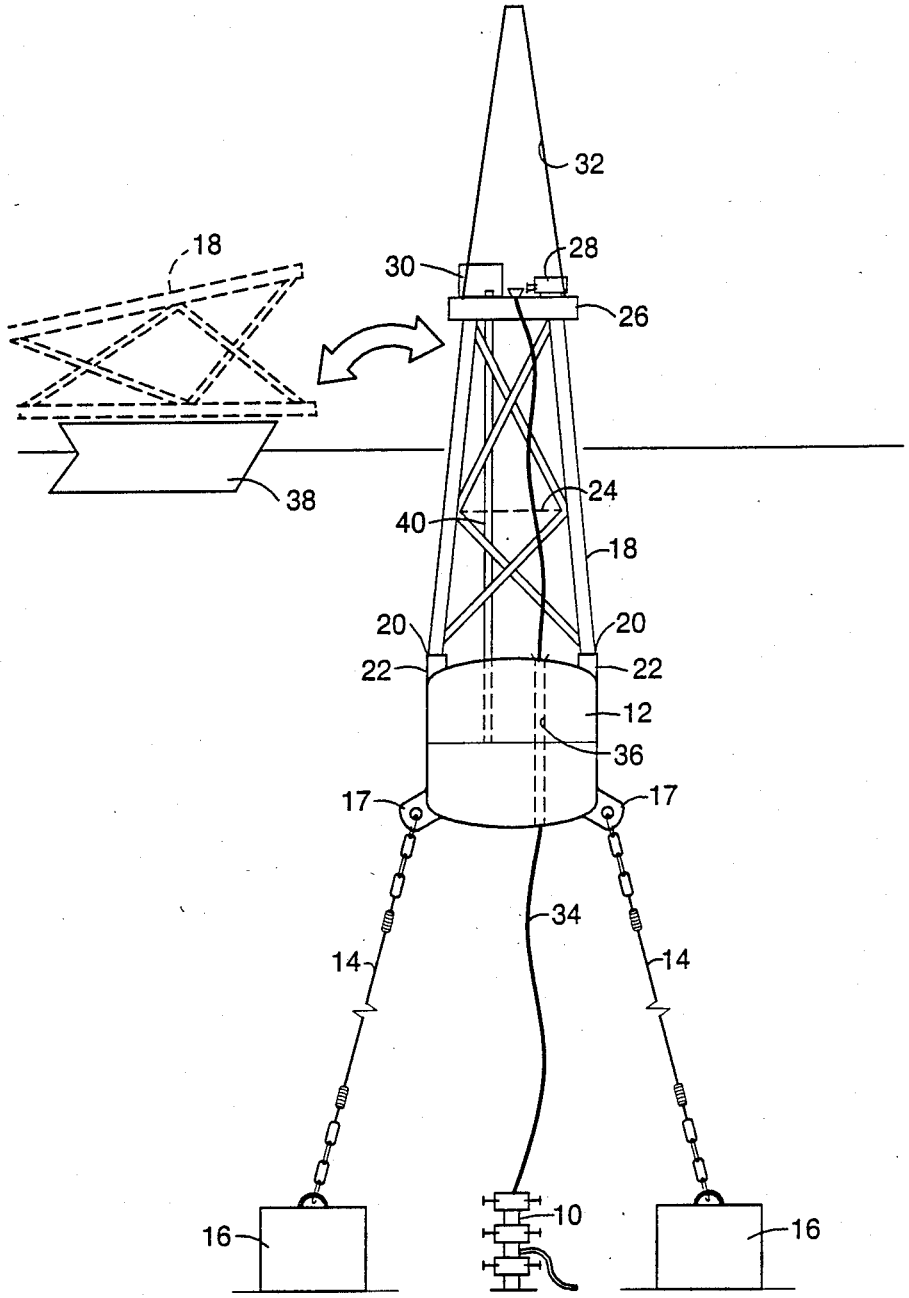
FIG. 2 is an elevational view of an offshore well test platform system anchored in a body of water in accordance with one embodiment of the present invention.

As shown in FIG. 2, a subsea well has been drilled and completed at the bottom of a body of water and is provided with a wellhead 10, which can be of any commercially available type. The wellhead 10 provides controlled access into the interior portions of the well such that well test, production and workover and completion operations can be conducted, as is well known to those skilled in the art. The wellhead 10, can be operated by a diver or a remotely operated vehicle (ROV), or it can be remotely operated by electric or hydraulic control mechanisms which can be operated from the surface on a floating vessel or on a platform structure.

Spaced above the wellhead 10 is a buoyant structure, such as a multicompartmented or solid tank or buoy 12, that is restrained below the surface of the water by a plurality of chains or cables or chain-cable combination 14 with any suitable form of anchors 16 on a lower end of each. To assist in maintaining the buoy 12 in a stable position, the upper ends of the cables 14 attach to a lower portion of the buoy 12, such as at lower dog ears 17 by connecting shackles and the like in a quiescent zone out of the action caused by winds and waves. The buoy 12 can be of any desired configuration, such as spherical, cylindrical, and is shown as a cylinder having domed ends in FIG. 2 and as a right cylinder in FIG. 3.

Figure 3:
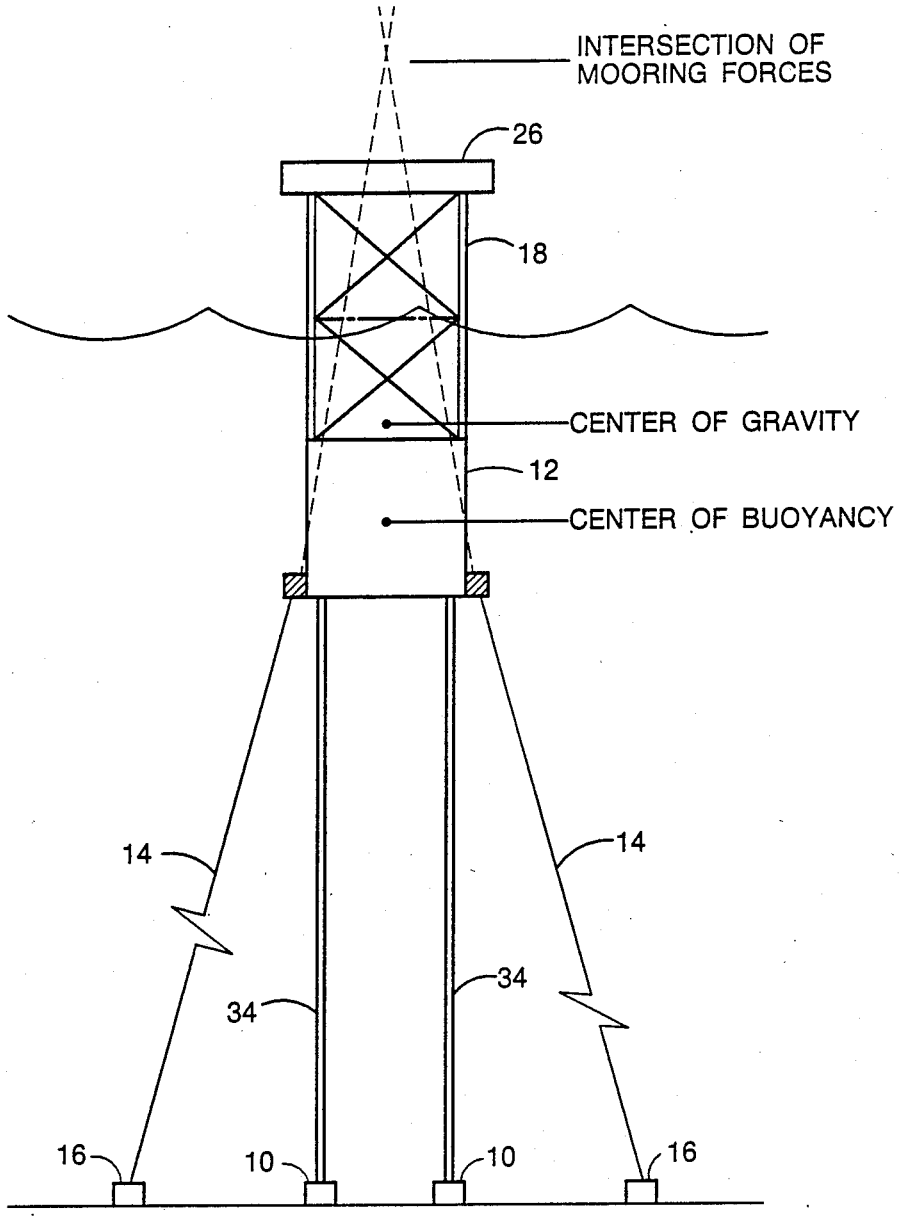
FIG. 3 is an elevational view of an alternate embodiment of the present invention.

Removably connected to an upper portion of the submerged buoy 12 is a space frame structure 18, which can be a cross braced or K braced steel structure or any layout within the space frame category that can either be vertically aligned or tapered, and is of sufficient height to extend upwardly above the surface of the water as shown in FIGS. 2 and 3. A lower portion of the legs of the platform structure 18 can be provided with male connectors 20, such as posts or pins, which are insertable into openings or sleeves 22 connected to the upper portion of the buoy 12. The weight of the platform structure 18 is sufficient to hold the male connectors 20 within the sleeves 22. However, latching connectors, pins or bolts, can be used to secure the platform structure 18 to the buoy 12, which in turn can be operated/released remotely from the surface or by a diver or an ROV. The internal portion of the space frame platform structure can include one or more horizontal braces which can be used for supporting the riser guides 24.

Connected to an upper portion of the platform structure 18 is a deck 26 of sufficient size to include necessary well test and workover equipment. This equipment can include one or more winches 28, a control station 30, an erectable/lowerable mast 32 for raising and lowering well test and logging equipment, artificial lift equipment, tubing and the like from/into the well(s). Flexible conduits or risers 34, which are well known to those skilled in the art, can pass exterior of the buoy 12 or through one or more internal passages 36 therein, and interconnect the well to the surface.

After the well has been drilled and the wellhead 10 installed, the anchoring devices 14 and 16 are lowered from a vessel and anchored in place around the wellheads 10. Next, the buoy 12 is lowered into the water in a ballasted or semiballasted condition and the upper portions of the anchoring cables 14 are connected thereto. The length of the cables 14 can be preset or adjusted onsite to place the buoy 12 within the desired quiescent zone beneath the surface of the water. The angle of the cables 14 has been found to be important and will be discussed later. The tension in the mooring lines is obtained from the net buoyancy of the buoy by means of deballasting.

A vessel 38, such as a barge, carries the platform structure 18 in a resting horizontal position. By means of launching or crane lifting on the vessel 38, as is well known to those skilled in the art, the platform structure 18 is lowered onto the upper portion of buoy 12 so that the lower portion of each leg of the platform structure 18 connects with the sleeves or openings 22 in the buoy 12. Then, the buoy 12 is fully deballasted, and any necessary equipment is transferred onto the deck 26.

If the legs of the jacket platform is welded onto the top of the buoy, the combined structure would be towed out by a work boat. The upending operation can be done by means of controlled flooding procedures, a process which is well known in the state of practice.

The flexible riser 34 may be lowered downwardly from the deck 26 through the buoy 12 and into connection with the wellhead 10, as is well known to those skilled in the art.

As a design alternative, the flexible riser 34 may be preinstalled with the lower end connected to the subsea wellhead 10 and the upper end supported by a bouyancy can (not shown). After the well test platform is in place, the flexible riser 34 can be connected to a bridle (not shown) and then retrieved through the passage 36 by the crew. A relatively straight passage through the riser 34 is desired, therefore, a winch 28 can be used to provide tension to the risers 34 to keep them in an essentially vertical position. The deck 26 can also include limited fluid storage, electrical generation, and personnel accommodation facilities; however, this is not preferred because of cost and weight.

To commence the well test operations, one or more vessels 38, which include the necessary fluid storage facilities and hydraulic and electrical power generating units, are anchored adjacent the platform structure 18 and connected to the necessary equipment within the control station 30 via flexible cables and conduits. After the initial well tests have been completed, platform structure 18 can be removed from the submerged buoy 12, placed back onto the vessel 38 and moved to other well locations. In the event that the well and/or reservoir does not prove to be economical, then the cables 14 can easily be disconnected and the buoy 12 can be retrieved and moved to another location for later use with the loss only being that of the cables which have been cut and the anchor devices 16, which may not be recovered.

Probably the most important feature of the present invention is the requirement that the cables 14 be placed outwardly from the wellheads 10 a prescribed distance, depending on the water depth and height of the structure so that the pitching motion of the deck 26 is minimized. For example, the cables 14 can be connected to a lower portion of the buoy 12 in the form of two diagonally opposite mooring lines from a 4-lined system. The motion stability of the buoy 12 and platform structure 18 is provided by virtue of the vertical separation between the mooring line attachment points and the center of buoyancy and the center of gravity. The angle of the cables 14 was determined to be very important to minimize the pitching motion of the unit. Therefore, it was found that if a force is applied to the unit, the lateral motions induced by the rotation and translational displacement of the C.G. have been found to be cancelled from each other on the deck level. This constraints the geometry of the buoy and platform structure in terms of the horizontal separation of the mooring lines, the angle of the mooring lines to the vertical, and the height of the structure. Specifically, it has been found that the point of the application of any force, such as wind, wave or currents, should be below the point of intersection of the mooring forces which extend imaginarily upwardly from the angles drawn by the anchored mooring cables 14, as shown in FIG. 3. In other words, it is preferred that the mooring force intersection be located at or above the deck structure 26. In this manner, the horizontal motion of the deck has been found to be greatly minimized. The well test platform does not heave due to the restrain of the tensioned mooring cables. To provide stability in the event of damage to one or more of the cables 14, the moment of the buoyant force about the mooring attachment should be greater than the moment of the weight about the mooring attachment point.

The cables 14 can be attached to the base of the buoy 12 in such a manner that the basic design consists of four equally spaced, laterally extending tensioned cables with an upper portion of each cable, including an additional length of cable or chain which can pass through tubular sleeves or guides on the bottom portion of the buoy 12. A chain stopper (not shown) can be attached to the buoy 12 instead of the dog ears 17. During the installation process, the chain stopper can be used to latch the upper portion of the cable 14 or chain extending from each anchor device 16 to hold the partially ballasted buoy 12 down during the installation process. A winch can be mounted on the deck 26 directly above each of the anchoring points for each cable 14 and can be used for tensioning the cable 14 during installation. These winches can be removed after the cable 14 have been tensioned and the chain stopper 17 set and secured. Thereafter, any excess cable extending above the chain stoppers can be removed or left if desired.

The buoy 12 can be in the form of a multicompartmented steel tank fitted with internal horizontal and/or vertical walls to divide the tank into spaces to provide a measure of damage control in the event that one or more spaces leaks. The spaces within the buoy 12 are compartments which provide a reasonable amount of buoyancy during the installation in the event that other spaces or compartments are flooded during the installation process. The installation process can also be facilitated by using auxiliary buoyancy in the form of inflatable or flexible tanks that can be attached at or near the water line around the buoy 12 in order to provide positive stability.

The deck 26 on the top of the platform structure 18 can be supported by crossbeams attached to the top of the legs of the platform structure 18. Secondary beams and peripheral bars can complete the support of the deck 26. To minimize the weight of the platform structure 18 and the deck 26, the deck 26 does not have to be fully covered, but can be covered with lightweight grating.

Flooding and vent piping systems 40 can be provided within the buoy 12, which can extend upwardly through the platform structure 18 to the deck 26 or internally through the leg 18 to the deck. The vent lines 40 can double as air intake lines for blowing water out of the compartments within the buoy 12, and compartments can be flooded by opening the flood valves, allowing them to free flood, even with the vents open. To expel water from the compartments, vent valves are closed and compressed air is transmitted to the vent lines which blows water out through the floodlines in the bottom of the compartments. Following the expulsion of the water, flood valves are closed, the vent valves are left closed and the compressed air space lines are valved off. In this way, the compartments remain under pressure equal to the pressure at the bottom of the flood valve, which will then help prevent water ingress into the buoy 12 in the event of valve leaks. Also, this provides a means for determining if leaks exist by simply monitoring the pressure in the compartments at the top of the vent line.

For a better understanding of the present invention and a more detailed description of one example of the present invention will be provided below. The example of the present invention described herein was based upon design criteria for a structure that could service a maximum of four wells in water depths of approximately 300 ft with moderate seas having a maximum wave height of 40 ft. It was also determined for the minimization of cost and weight that a maximum deck load would be approximately 30 tons. From this initial design criteria, it is determined that the platform and buoy in combination would have a height of approximately 85 ft, with the deck located about 28 ft above the water.

The center of gravity of the buoy in the above described example is found to be about 41 ft above the base of buoy 12 and the center of buoyancy was about 13 ft above the baseline or bottom portion of buoy 12.

A deck of approximately 25 ft by 25 ft for the above described example provides ample room for wireline workover and/or well test operations. The subsea wellheads 10 are spaced approximately 12 ft apart. The detailed dimensioning of the above described example is provided below:

| | |
|---|---|
| Height to deck | About 86 ft |
| Normal draft | 56 ft |
| Wave clearance to deck | 28 ft |
| Deck width and length | 25 × 25 ft |
| Design load on deck | 30 tons |
| Platform structure height | 58 ft |
| Number of legs | 4 |
| Spacing at bottom | 18 ft |
| Spacing at top | 15 ft |
| Buoy diameter | 26 ft |
| Buoy height | 26 ft |
| Compartments | 3 |

Wherein the present invention has been described in particular relation to the drawings attached hereto and the example described herein, it should be understood that other and further modifications apart from those shown or suggested herein, may be made within the scope and spirit of the present invention.

What is claimed:

1. An offshore well test platform system positionable above one or more underwater wells comprising:

a submergible buoy to be restrained below the surface of the water and above one or more underwater wells;

a platform structure connectable to the buoy and having an upper portion extending above the surface of the water when connected to the buoy in an installed condition;

a well test platform deck connected to the upper portion of the platformed structure;

flexible riser means extendable between the one or more underwater wells and the platform deck for providing passage therethrough for well test or workover operations; and restraining means for connecting the submerged buoy to subsea anchors, the restraining means consists of equally spaced, laterally extending tensioned anchoring means having a single intersection of mooring forces at or above the platform deck.

2. An offshore well test platform system of claim 1 wherein the buoy includes a vertical bore therethrough for passage of each flexible riser.

3. An offshore well test platform system of claim 1 wherein the buoy is submerged within a quiescent zone out of an area effected by the action of wind and waves.

4. An offshore well test platform system of claim 1 wherein lower ends of legs of the platform structure are removably insertable within openings in the upper portion of the buoy.

5. An offshore well test platform system of claim 1 wherein the mooring force intersection of the anchoring means is located above the center of gravity of the system.

6. An offshore well test platform system of claim 1 and including means associated with deck for maintaining the riser in tension during well testing or workover operation.

* * * * *